US006763290B2

(12) United States Patent
Johnson

(10) Patent No.: US 6,763,290 B2
(45) Date of Patent: Jul. 13, 2004

(54) CAB SIGNAL QUALITY DETECTING AND REPORTING SYSTEM AND METHOD

(75) Inventor: John Hayward Johnson, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/294,261

(22) Filed: Nov. 13, 2002

(65) Prior Publication Data

US 2003/0158637 A1 Aug. 21, 2003

Related U.S. Application Data

(60) Provisional application No. 60/357,619, filed on Feb. 15, 2002.

(51) Int. Cl.[7] ..... G06F 17/00

(52) U.S. Cl. ..... 701/19; 246/187 R

(58) Field of Search ..... 701/19; 246/187 R, 246/220, 121, 125; 105/238.1, 404, 375

(56) References Cited

U.S. PATENT DOCUMENTS

| | | | | |
|---|---|---|---|---|
| 3,937,427 A | * | 2/1976 | Buzzard | 246/34 CT |
| 3,946,972 A | | 3/1976 | Grundy | |
| 4,022,408 A | | 5/1977 | Staples | |
| 4,314,234 A | | 2/1982 | Darrow et al. | |
| 4,437,056 A | | 3/1984 | Pierro, Jr. | |
| 4,467,270 A | | 8/1984 | McElroy et al. | |
| 5,263,669 A | | 11/1993 | Ehrlich | |
| 5,263,670 A | | 11/1993 | Colbaugh et al. | |
| 5,330,134 A | | 7/1994 | Ehrlich | |
| 5,340,062 A | | 8/1994 | Heggestad | |
| 5,358,202 A | | 10/1994 | Tse et al. | |
| 5,459,663 A | * | 10/1995 | Franke | 701/20 |
| 5,501,416 A | | 3/1996 | Capan | |
| 5,501,417 A | * | 3/1996 | Capan | 246/63 R |
| 5,586,736 A | | 12/1996 | Mollet | |
| 5,628,478 A | | 5/1997 | McConnel et al. | |
| 5,711,497 A | | 1/1998 | Andrianos et al. | |
| 5,845,272 A | | 12/1998 | Morjaria et al. | |
| 5,978,718 A | | 11/1999 | Kull | |
| 5,995,881 A | | 11/1999 | Kull | |
| 6,243,628 B1 | | 6/2001 | Bliley et al. | |
| 6,301,531 B1 | | 10/2001 | Pierro et al. | |
| 6,324,659 B1 | | 11/2001 | Pierro | |
| 2002/0153456 A1 | * | 10/2002 | Yerge | 246/34 CT |

FOREIGN PATENT DOCUMENTS

| | | |
|---|---|---|
| EP | 0 779 196 A1 | 6/1997 |
| EP | 0 893 323 A1 | 1/1999 |

* cited by examiner

*Primary Examiner*—Marthe Y. Marc-Coleman
(74) *Attorney, Agent, or Firm*—Senniger, Powers, Leavitt & Roedel; Carl Rowold

(57) ABSTRACT

A system and method for railroad cab signal quality detection and reporting for use in connection with a railroad cab signaling system in which a status signal is carried on a railroad rail. The status signal has a cab signal parameter that is indicative of a status of a zone of track. A signal detector detects the status signal transmitted via the railroad rail. A signal measurement subsystem associated with the signal detector measures the cab signal parameter. A quality analysis subsystem analyzes the measured cab signal parameter and determines a measure of quality of the cab signal parameter. The system may include equipment that is mounted on a rail vehicle, such as a locomotive, or mounted along a block of track, or on portable equipment. The system may also include a cab signal quality collection and reporting system. The method includes detecting the cab status signal and measuring the cab signal parameter from the detected status signal. The measure of quality of the measured cab signal parameter is determined and is reported.

39 Claims, 4 Drawing Sheets

CAB SIGNAL QUALITY DETECTING AND REPORTING SYSTEM AND METHOD

RELATED PATENT APPLICATIONS

This application is a non-provisional U.S. patent application based on provisional U.S. Patent Application No. 60/357,619 filed on Feb. 15, 2002.

BACKGROUND OF THE INVENTION

1. Field of the Invention

The invention relates generally to railroad signaling systems and methods. More particularly, the invention relates to systems and methods for detecting and reporting incorrect operation of cab signal track circuits.

2. Description of the Prior Art

Railroad signaling has traditionally been based upon a concept of protecting zones of track, sometimes called "blocks," by means of some form of signal system that conveys information to the locomotive engineer about the status of the blocks of track ahead. Typically, wayside signal lights are located along the track and are controlled by electrical logic circuits responsive to the presence of railway vehicles and the status of blocks that are relevant to a given wayside signal. In such systems, each wayside signal typically displays a pattern of lights, called the "aspect" of the signal, which is visible to the engineer in the locomotive and indicates the status at that location.

A more advanced signaling system in widespread use is referred to as cab signaling and may be used with or without wayside signal lights. In cab signaling, the same or similar logic that determines block status for display on the wayside signals is also used to generate one of several forms of encoded signals (e.g., encoded electrical current signals) carried in the rails, block status being represented by the selection of the code rate used. Inductive pickup coils are mounted on the locomotive ahead of the lead wheels and just above the rails for the purpose of sensing the magnetic fields around the rails produced by the encoded current. In modern systems, a computer on-board the locomotive decodes the detected information to determine the status and thereafter displays the proper aspect in the engine cab by a pattern of lights in a manner similar to a wayside signal. One advantage, of course, is that the information is made available to the train crew on a continuous basis and updated when changes in status occur, rather than restricting the communication of status information to periodic intervals along the track at which the engineer is required to observe and read the next wayside signal.

The detectors or pickup coils typically used in on-board cab signal systems are iron core or ferrite core inductors employed in pairs, one being mounted above each rail. The carrier frequency of the cab signal is typically in the range of from about 40 Hz to 100 Hz but may be higher. For example, the carrier frequency may be in the kilohertz range such as 4,550 Hz. In other systems, the operating range for cab signal is 73 Hz to 100 Hz. In yet other systems, the range of 78.3 Hz to 88.3 Hz is considered a good operating range for a cab signal. Different modulation rates are used to convey different states that are converted in an on-board computer to cab signal aspects. Modulation rates for the cab signal and corresponding aspects are well known in the prior art. For example, in one prior art system modulation rates for the 40 Hz carrier are slower than some of those used at higher frequencies, because of the ringing effects of the large filters needed to couple 40 Hz to the track and block other frequencies used for grade crossing equipment. Suggested rates for a 40 Hz carrier and the aspects associated with each range are from the fastest rate of 75 pulses per minute (ppm) to the slowest of approximately 27 ppm. The modulation is generally non-symmetrical in that the "off" time of all rates below 75 ppm is the same, 600 milliseconds. In one embodiment, the cab signal parameter that is encoded in the cab status signal indicates a status of "restricting" where the modulation rate is 0, a status of "approach stop" where the modulation rate is 75 ppm, a status of "approach restricting" where the modulation is 32 ppm, a status of "approach diverging" where the modulation rate is 39 ppm, a status of advance approach" where the modulation rate is 27 ppm, and a status of "clear" where the modulation rate is 50 ppm.

If the equipment used to generate the cab signal in the rails is malfunctioning or operating marginally, the on-board display will generally show a restrictive indication in the locomotive cab. This will cause the train to be slowed to a restricted speed until a track circuit block with correctly operating cab signals is reached. The slowing of trains in inoperative track circuit blocks can cause undesirable train delays. In the worst case, an unexpected restrictive aspect can contribute to the risk of train derailment, such as when the train is required to slow from a high speed to restricted speed in a curved section of track.

Currently, the locomotive operating crew monitors the on-board aspect display and identifies unexpected indications when they occur. When these indications are observed, the cause is generally not known. The crew reports the unexpected indication that may be addressed at the next scheduled maintenance opportunity for the locomotive. Without further diagnostic capabilities, the unexpected indication may be a correct indication caused by movements of trains or switches ahead, or may be due to a failure of the on-board cab signal detection equipment or a failure of the track circuit. However, in some cases, where a restrictive aspect might be expected by the train crew, and no wayside signal lights are visible, failure of cab signal track circuits will not be noticed or reported by the crew.

Therefore, there is a need for a system and method for detecting an incorrect operation of failed or marginally operating cab signal track circuits and/or cab signal display system so that such failures and marginal operating conditions may be identified and repaired in a timely manner. Advantageously, such a system and method could be automated to improve the reliability of reporting cab signal problems and to reduce the labor associated with reporting such problems. Further, such a system and method could be used to provide an accurate indication of the cause of a particular cab signal problem and distinguish between track circuit failures and failures associated with equipment on-board a locomotive. Such a system and method could also improve the timeliness and/or effectiveness of repairing cab signal problems. For example, a repair crew could be automatically dispatched and provided with information regarding the type of problem detected and the type of equipment and parts likely required to correct the detected problem. Likewise, the repair crew can use a similar system and/or method to detect when it has encountered the failed track circuit and when the failed circuit has been restored to proper operation.

BRIEF DESCRIPTION OF THE INVENTION

In one form, the invention relates to a railroad cab signal quality detection system for use in connection with a railroad cab signaling system in which a status signal is carried on a railroad rail. The status signal may include an encoded cab signal parameter that is indicative of a status of a zone of track. A signal detector detects the status signal transmitted via the railroad rail. A signal measurement subsystem is associated with the signal detector and measures the cab signal parameter. A quality analysis subsystem analyzes the measured cab signal parameter and determines a measure of the quality of the cab signal parameter.

In another form, the invention is a railroad cab signal quality collection and reporting system for use in connection with a railroad cab signaling system. In this form, the invention includes a data collection system that collects data indicative of a measure of a quality of the cab signal parameter of the status signal. A quality analysis and reporting system analyzes the collected data and generates reports responsive to the collected data and indicative of the measure of quality of the cab signal parameter.

In yet another form, the invention is a system comprising a locomotive, a cab signal detector, a cab signal conditioner, a cab signal converter, and a cab aspect display system. A signal measurement subsystem is associated with the cab signal detector and measures a cab signal parameter. A quality analysis subsystem analyzes the measured cab signal parameter and determines a quality of the cab signal parameter. A reporting subsystem receives the determined quality of the cab signal parameter from the quality analysis subsystem. The reporting subsystem generates a report containing the received determined quality.

In another form, the invention is a railroad cab signaling system comprising a cab signal parameter and a cab signal transmitter for transmitting a status signal onto a railway rail. This form of the invention also includes a signal detector for detecting the status signal transmitted via the railroad rail. A signal conditioner conditions the status signal detected by the signal detector and provides a conditioned cab signal. A signal converter associated with the signal conditioner receives the conditioned cab signal and converts the conditioned cab signal to a digital cab signal. A signal measurement subsystem measures a cab signal parameter from the digital cab signal. A quality analysis subsystem analyzes the measured cab signal parameter and determines a measure of quality of the cab signal parameter. A reporting subsystem receives the determined measure of quality of the cab signal parameter from the quality analysis subsystem and generates a report containing the received determined quality.

In another form, the invention is a quality monitoring method for use with a railroad cab signaling system in which a status signal is carried on a railroad rail. The status signal includes an encoded cab signal parameter that is indicative of a status of a zone of track. The quality monitoring method comprises detecting the status signal. The cab signal parameter is measured from the detected status signal. A measure of quality of the measured cab signal parameter is determined. The determined measure of quality of the measured cab signal parameter is reported.

These and other forms of the present invention will become more apparent and in part pointed out hereinafter.

DETAILED DESCRIPTION

Figure 1:
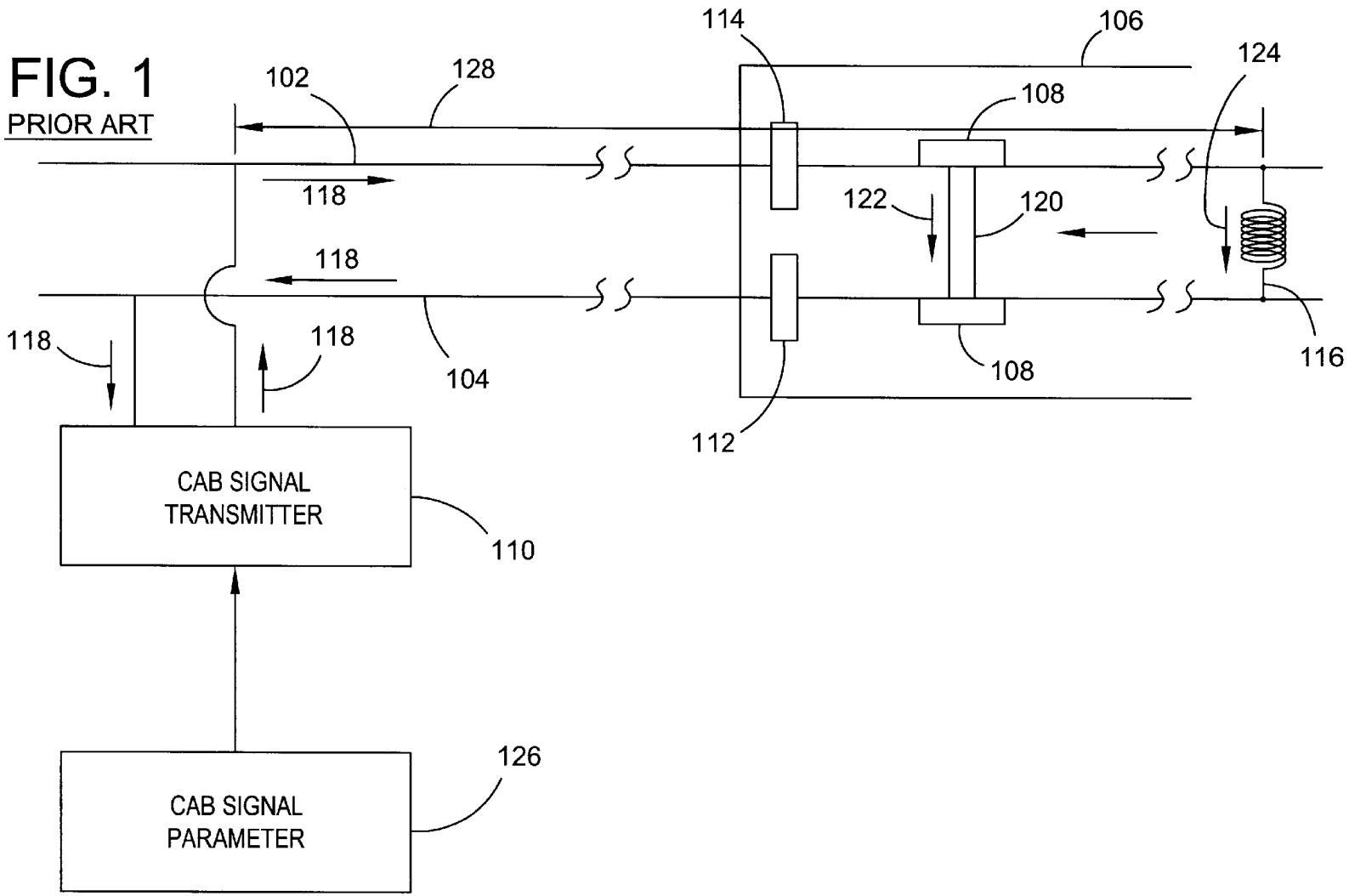
FIG. 1 PRIOR ART
FIG. 1 is an illustration of a prior art railway cab signaling system.

Referring first to FIG. 1, railway cab signaling systems 100 are well known in the prior art. FIG. 1 illustrates one such railway cab signaling system implementation. A railway vehicle 106 such as a locomotive has wheels 108 that ride on rails 102 and 104. Wheels 108 are connected by axle 120. A cab signal parameter 126 identifies one or more operating parameters of the train on the railway track, as discussed below. The cab signal parameter 126 is encoded in the cab status signal 118 and transmitted by cab signal transmitter 110 through the rails 102 and 104. As shown in FIG. 1, the transmitted cab status signal 118 is transmitted in rail 102. In the case where there is no railway vehicle 106 on the tracks within a predefined cab signal track circuit 128 or block, the cab status signal 118 is transmitted from rail 102 to rail 104 via an impedance rail shunt 116 to complete the cab signal track circuit 128 and thereby the transmission of cab status signal 118 as denoted at 124. In the case where railway vehicle 106 is present within the predefined cab signal track circuit 128, the wheels 108 and axle 120 close the circuit for cab status signal 118 as denoted at 122. The railway vehicle 106 is equipped with cab signal detectors 112 and 114 that detect the cab status signal 118 from rails 104 and 102, respectively.

Figure 2:
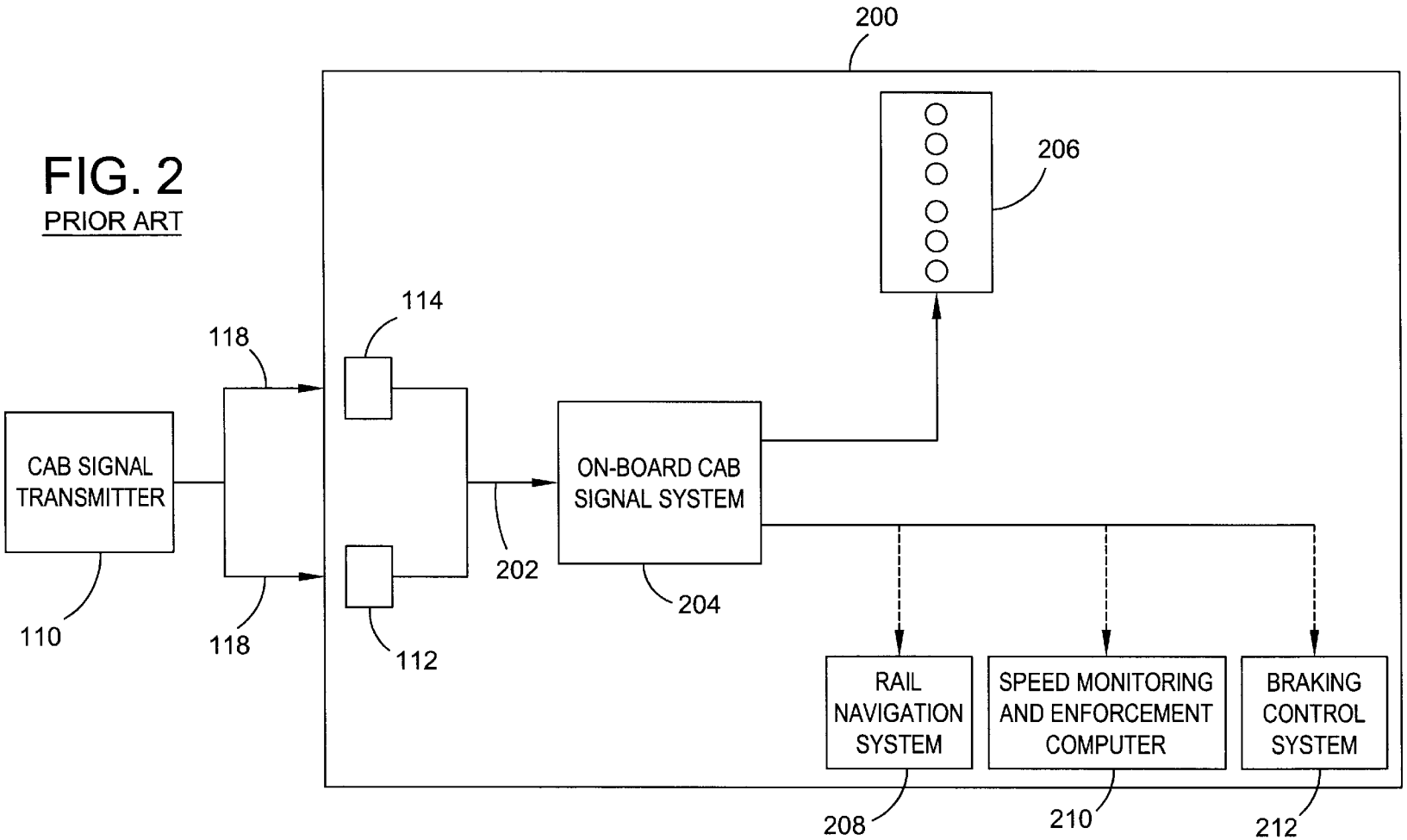
FIG. 2 PRIOR ART
FIG. 2 is a block diagram of a prior art railway vehicle operating system including an on-board cab signal system.

Referring now to FIG. 2, cab signal parameter 126 is encoded in the cab status signal 118 (hereinafter referred to as the cab signal 118) and transmitted into a cab signal track circuit 128 by the cab signal transmitter 110. The railway operations system 200 receives the cab signal 118 by detectors 112 and 114 and provides a received cab signal 202 to an on-board cab signal system 204. It should be noted that the cab signaling system 100 as discussed above and the on-board cab signal system 204 are often generically referred to as the "cab signaling system" which is consistent with this current invention and it is implied that cab signaling system 100 includes, in one embodiment the on-board cab signal system 204. The on-board cab signal system 204 generally provides information to a cab signal aspect display 206 to indicate the status of the cab signal parameter 126 indicative of the present aspect, as discussed below. In some prior art designs, the on-board cab signal system 204 provides input to other systems within the railway operations system 200. For example, these may include a rail navigation system 208, a speed monitoring and enforcement system 210, or a braking control system 212.

Figure 3:
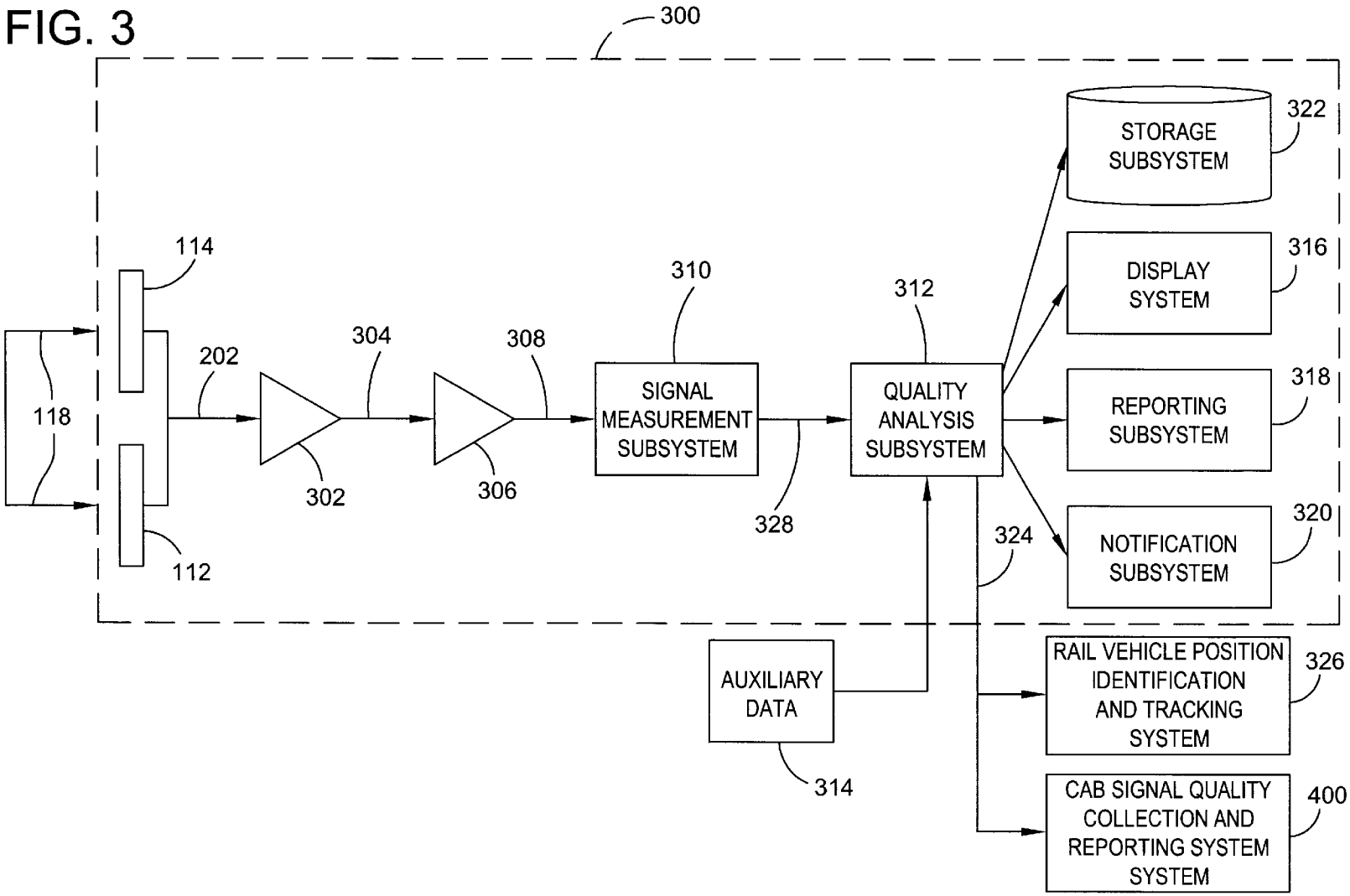
FIG. 3 is a block diagram of a railroad cab signal quality detection system according to one form of the invention.

FIG. 3 illustrates one embodiment of the cab signal detection and reporting system of the present invention. Various arrangements or subsystems of the cab signal detection and reporting system 300 may be present at the railway track, on a railway vehicle 106, as portable equipment, or located in various deployed arrangements. In one embodiment, track cab signal quality detecting and reporting system 300 is carried on-board a railway vehicle 106 such as a locomotive that is equipped with signal detectors 112 or 114 that are also referred to as cab signal pickup coils. The detectors are mounted above the rails 102 and 104 in front of the leading wheels 108 of the railway vehicle 106. System 300 may be constructed and arranged for portable operation or for operation at a fixed location. For example, the cab signal pickup coils 112 and 114 may be mounted above the rails in front of a rail shunt 116. In either case, the cab signal 118 with the encoded cab status parameter 126 flows down one rail 102, as illustrated in FIG. 1 and discussed above, then through the vehicle axle 120 or shunt 116, and then returns via the mated rail 104. The cab signal 118 induces a similar signal in the detectors 112 and 114 that is provided to an analog signal conditioning circuit 302 as received cab signal 202. The conditioning circuit 302 prepares the received cab signal 202 for conversion from analog to digital form. The conditioned cab signal 304 is provided to analog to digital converter 306 to produce a digitized cab signal 308. In one embodiment, the conditioning circuit 302 is operable for rejecting frequencies higher than one half of the sample rate of an analog to digital converter 306. For example, the conditioning circuit 302 may comprise, among other components, filters, a filter circuit or a filter bank to filter one or more ranges of frequencies. However, in other embodiments, conditioning circuit 302 may perform additional operations, such as, for example, rejecting frequencies except those near a nominal cab signal carrier frequency as discussed below.

Other embodiments of system 300 may be deployed on a railway maintenance vehicle (referred to as a high railer), deployed as a portable test set or permanently mounted along a track circuit 128 in a railway yard. Such systems would aid maintenance crews in the detection and repair of faulty track circuits 128. For example, in some cases a track circuit 128 fails because of a broken or cracked rail 102 or 104. In these cases, it is unsafe to send a locomotive through the track circuit 128 because of the risk of derailment. A smaller track maintenance vehicle (i.e., a high-railer) could be sent, with an on-board quality analysis system 300. The system would notify the on-board crew when the location of the rail break was reached. The vehicle would be able to scan for the break rapidly (e.g. 25 mph). This would be much faster than the alternative, which is to have someone walk the length of the track circuit 128, carefully inspecting both rails 102 and 104 for a crack that is sometimes nearly invisible.

In the illustrated embodiment, the conditioned cab signal 304 is output from conditioning circuit 302, and is converted to digital form 308 by the analog to digital converter 306. The digitized cab signal 308 is provided to a signal measurement subsystem 310. The signal measurement subsystem 310 provides various signal processing functions as discussed below, but produces as one of its outputs, a digital representation 328 of the cab signal parameter 126.

In one embodiment of a railway vehicle 106 is equipped with both a cab signal aspect display system 206 and a cab signal quality detecting and reporting system 300. The components of the cab signal acquisition circuitry 302, 306, and 310 may be shared by the cab signal aspect display system 206 and the cab signal quality reporting system 300. Also, when a railway vehicle 106 is equipped with both a cab signal aspect display system 206 and a cab signal quality reporting system 300, some form of a signal measurement subsystem 310 (e.g., a parameter measurement system) may be used in connection with both systems and, therefore, may be shared between both systems. In one embodiment, such a signal measurement subsystem 310 comprises a digital subsystem.

The digitized cab signal 308 is output by the analog to digital converter 306. The digitized cab signal 308 is passed to a signal measurement subsystem 310 so that one or more cab signal parameters 126 can be measured. Such parameters 126 can include, for example, carrier frequency, carrier amplitude, code rate, duty cycle, aspect, and/or other quality parameters as desired. The measurements are provided to the quality analysis subsystem 312 as a digital representation of the cab signal parameter 328. The quality analysis subsystem 312 uses one or more rules to distinguish between valid and invalid cab signal parameters 126, and to distinguish between possible failure modes of the cab signal 118. Such rules may be predetermined or dynamically determined (e.g., in real or near-real time). For example, and as discussed later in more detail, a rule may be such that a invalid cab signal 118 is one where the signal power is less than 50 percent of a calibration level or greater than 1,000 percent of the calibration level. For levels between these two levels, a valid cab signal 118 is determined. In another embodiment, a rule may be that a valid cab signal parameter 126 is where the rail current is between 50 percent and 1,000 percent of 1.5 Amps. Currents outside this range are determined to be an invalid cab signal 118. In another embodiment, the measurement of quality of the code period or the operating carrier frequency may be the basis for a rule.

The quality analysis subsystem 312 may also identify the marginal operation or trends in the operation of the on-board cab signal system 204 or cab signaling system 100, components thereof, or of parameters that indicate over time the degrading performance of one or more components of one of the systems. Such components that may be detected include the cab signal track circuit 128, cab signal transmitter 110, or cab signal detectors 112 and 114. For example, the quality analysis subsystem analyzes information in the cab signal parameter 126 to determine a source of a failed or a failing track circuit or onboard cab signal detector or system 204 or onboard operations system 200. Auxiliary information or data 314 may be optionally supplied to the quality analysis subsystem 312. Optional auxiliary information that may be useful includes, for example, vehicle identification, vehicle location and direction of travel, the current time and/or date. The exact set of cab signal parameters 126, auxiliary data 314, and rules used vary in different embodiments, depending on the details of the cab signaling system 100, the on-board cab signal system 204, the availability of auxiliary data 314, and other factors such as the common failure modes of the cab signal track circuits 128 (as shown in FIG. 1) for a particular railroad.

The quality analysis subsystem 312 processes the digital representation of the cab signal parameter 328 and the optional auxiliary data 314 (if any) and provides information to other subsystems indicative of the cab signal quality. As shown in FIG. 3, the quality analysis subsystem 312 may provide reporting and analysis information along with associated auxiliary data 314 to a local storage subsystem 322 or memory. Information may also be provided to a local display system 316 that may be a cab signal aspect display 206 or may be another display such as an on-board display or computer equipped with a graphics display. The quality analysis subsystem 312 may also provide information or reports to a reporting subsystem 318, which formats reports for presentation to operating crews. Another output for the quality analysis subsystem 312 may be to provide information or messages to a notification subsystem 320 that provides notifications to the on-board operating crew or remotely to train maintenance personnel. Such a notification subsystem 320 may in one embodiment be comprised of a display or the cab aspect display system 206. In another embodiment, the quality analysis subsystem 312 may be equipped with a communications link 324 or facility such as a wireless, cellular telephone, or radio transmission facility. Such a communications link 324 would be utilized to transmit the cab signal quality analysis information and associated auxiliary data to a remote maintenance or administration center or facility. For example, this may include reporting the information and analysis related to the current or past cab signal parameter 126 to a remote rail vehicle position identification and tracking system 326 or a remote cab signal cab signal quality collection and reporting system 400. In particular, in embodiments using cab signal quality collection and reporting system 400 (discussed in greater detail below in connection with FIG. 4), reports are stored and/or transmitted in a format that permits the reports from the various equipped railway vehicles 106 to be collected together in a central storage system 404. The exact storage or transmission method for the quality reports may vary, depending on, for instance, the availability of local storage 322, radio networks, or other means of storage or transmission. Of course, in alternative embodiments one or more than one of these subsystems may be incorporated into the quality analysis subsystem 312.

The quality analysis subsystem 312 includes reporting rules that may be utilized analyze and report quality problems in various formats, at various reporting frequencies and with various rules to the various outputs as described above. For example, rules may be defined to produce periodic reports at regular time intervals or periodic reports at regular distance intervals for distances traveled by the railway vehicle 106. Reports may also be generated by changes of the cab signal parameters 126 or auxiliary data, such as changes of cab signal aspect, carrier frequency, carrier amplitude, code rate, rail current, or duty cycle. In other cases, the quality analysis subsystem 312 may generate reports when encountering a cab signal flips, where a flip reflects a change of cab signal aspect shorter than a defined duration. Cab signal parameters 126 falling inside or outside of specified ranges may also generate reports. Such parameters and ranges are discussed in more detail below. Additionally, reports may be generated when the railway vehicle 106 is entering or exiting a cab signal track circuit 128 or when it is located at one or more desired points within each block. Of course, cab signal quality reports may be generated by the quality analysis subsystem 312 based on other requirements or events as necessary to provide effective operation of the cab signal detecting and reporting system 300 for the railway vehicle 106 or the railroad operator.

As a more detailed example, a quality report may be generated when the railway vehicle 106 enters a new cab signal track circuit 128 based on tag information. In one such embodiment, the report may be triggered on or about 16 seconds after the railway vehicle 106 enters a new cab signal track circuit 128. In other embodiments, a report may be generated when the railway vehicle 106 is located within a cab signal area or in a dark area. A dark area is a zone of track without cab signals 118. For example, when in a cab signal track circuit 128, a report may be generated at regular distances as traveled by the railway vehicle 106. In one such embodiment, a report is generated within 16 seconds of the railway vehicle 106 first entering a new cab signal track circuit 128. Additional reports may be generated every 1,000 meters that the railway vehicle 106 travels within the cab signal track circuit 128. In a similar manner, in other embodiments, if a railway vehicle 106 is in a dark area, reports may be generated at regular distances traveled by the railway vehicle 106 such as every 1,000 meters, so long as the railway vehicle 106 is located within the dark area.

As another example, a report may be generated when the rail current exceeds a preset threshold. In one embodiment, where the rail current exceeds 14 Amps or 933 percent of the calibration level, a quality report is generated.

The contents of a quality report as generated by the quality analysis subsystem 312 or the reporting subsystem 318 can vary, depending on, for example, the cab signal parameters 126 of interest on a given railway, the available auxiliary information 314, and whether the centralized or off-track cab signal quality collection and reporting system 400 is used. Quality reports may include one or a combination of parameters, information or data that include measurements of the quality and/or functionality of the on-board cab signal system 204, the cab signaling system 100, or the track circuit 128. A quality report may include cab signal parameters 126 such as cab signal aspect, cab signal power status, carrier frequency, carrier amplitude, code period status, code rate, or duty cycle. These may be the cab signal parameters 126 that are current at the time of the report or may be the cab signal parameters 126 that had been detected since the last report was generated, or that was detected over a defined period of reporting time. Reports may also include an indication of the validity or invalidity of any or all of the cab signal parameters 126 as analyzed by the quality analysis subsystem 312. In order to aid in diagnosis of on-board cab signal system 204 or on-board operations systems 200, the report may include an indication of which detectors 112 or 114 or coils were in use for railway vehicles 106 with cab signal pickup coils 112 and 114 at both ends of a railway vehicle 106. The report may also include an indication of the quality analysis subsystem 312 rules that generated the report, such as a periodic report, or cab signal flip. Additionally, auxiliary information 314 associated with the cab signal parameter 126 may be retrieved by the quality analysis system 312. Such auxiliary information 314 may comprise vehicle ID, geographic or GPS location, date, time, and/or direction of travel or other items desired for interpretation and analysis of an event or a report.

The content of these reports may vary based on the information being represented and the applicable rule. For example, a report on the cab signal power status may indicate the signal power level of the cab signal 118 or ranges for the cab signal power. In one embodiment, the report indicates where the signal power is above, below or within the calibration level. The power status may be reported where the signal power is less than 50 percent of a calibration level, greater than 1,000 percent of the calibration level, or if the cab signal 118 is equal to or between 50 percent and 1,000 percent of the calibration level, the actual cab signal value or the percent of the signal value of the calibration level may be reported. In one embodiment, the cab signal threshold of rail current may be 1.5 Amps. In this case, the cab signal transmitter 110 may be set to deliver between 2.2 Amps and 13.0 Amps of cab signal 118. In the embodiment discussed above, cab signal quality reports may be generated at power levels between 50 percent and 1,000 percent of the calibration level that equates to approximately 0.75 Amps and 15.0 Amps. Additional ranges may be possible depending on the design and arrangement of cab signal detectors 112 and 114 and on-board cab signal system 204 in other embodiments.

As another example, a quality report may be generated for the code period status. To report the quality of the code period, in one embodiment a quality report may indicate "unknown" when the power level is out of range and the status cannot be determined. The report may indicate "<100 ms" when the power is within range and the period is below 100 milliseconds (ms). An indication of ">2,000 ms" may be indicated when the power is in range and the period is above 2,000 ms. Where the power is in range and the period is between 100 ms and 2,000 ms, the report may indicate the actual code period in milliseconds.

As yet another example, the carrier frequency status may be reported by the quality report. In one embodiment, desirable operating frequencies for the cab signal range from 78.3 Hz to 88.3 Hz. A quality report may be generated to indicate "unknown" when the cab signal power level is out of range. A quality report may indicate "bad" when the cab signal power level is within range but the frequency is not accepted as a valid cab signal 118 due to the frequency being outside of the expected or desirable operating frequency for cab signals 118. When the frequency is within the range of desirable operating frequencies, the carrier frequency status may report an indication of "good."

Any or all of the reporting rules of the quality analysis subsystem 312 may also cause a notification of a preferred corrective action to be output. Such a notification could instruct a repair crew to investigate and/or to fix a detected quality problem. In one embodiment, the notification generally identifies the failing track circuit location or failing railway vehicle identification, and provides additional information regarding the type of failure (e.g., too-high carrier frequency or too-low cab signal amplitude). These notifications can be stored or transmitted in a manner similar to that used for quality reports. The stored or transmitted notifications may be checked on a regular basis by maintenance personnel. Additionally, an indicator may be used to signal the existence of a new notification requiring corrective action. If a cab signal quality collection and reporting system 400 is not used, notifications (if any) may originate directly from the quality analysis subsystem 312. If, however, cab signal quality collection and reporting system 400 is present, notifications can be generated from the analysis and reporting subsystem 318, and might also come from the on-board quality analysis subsystem 312.

When a railway vehicle 106 is equipped with both a cab signal aspect display system 206 and a cab signal quality detecting and reporting system 300, parameter measurement 310 and quality analysis 312 can be performed within the same equipment as the cab signal aspect display system 206. Further, the measurement subsystem 310 and quality analysis subsystem 312 are shown separately to better facilitate a description of aspects of the invention, but they may be either combined or separate, and may be implemented using hardware or software, or a combination of both hardware and software.

Figure 4:
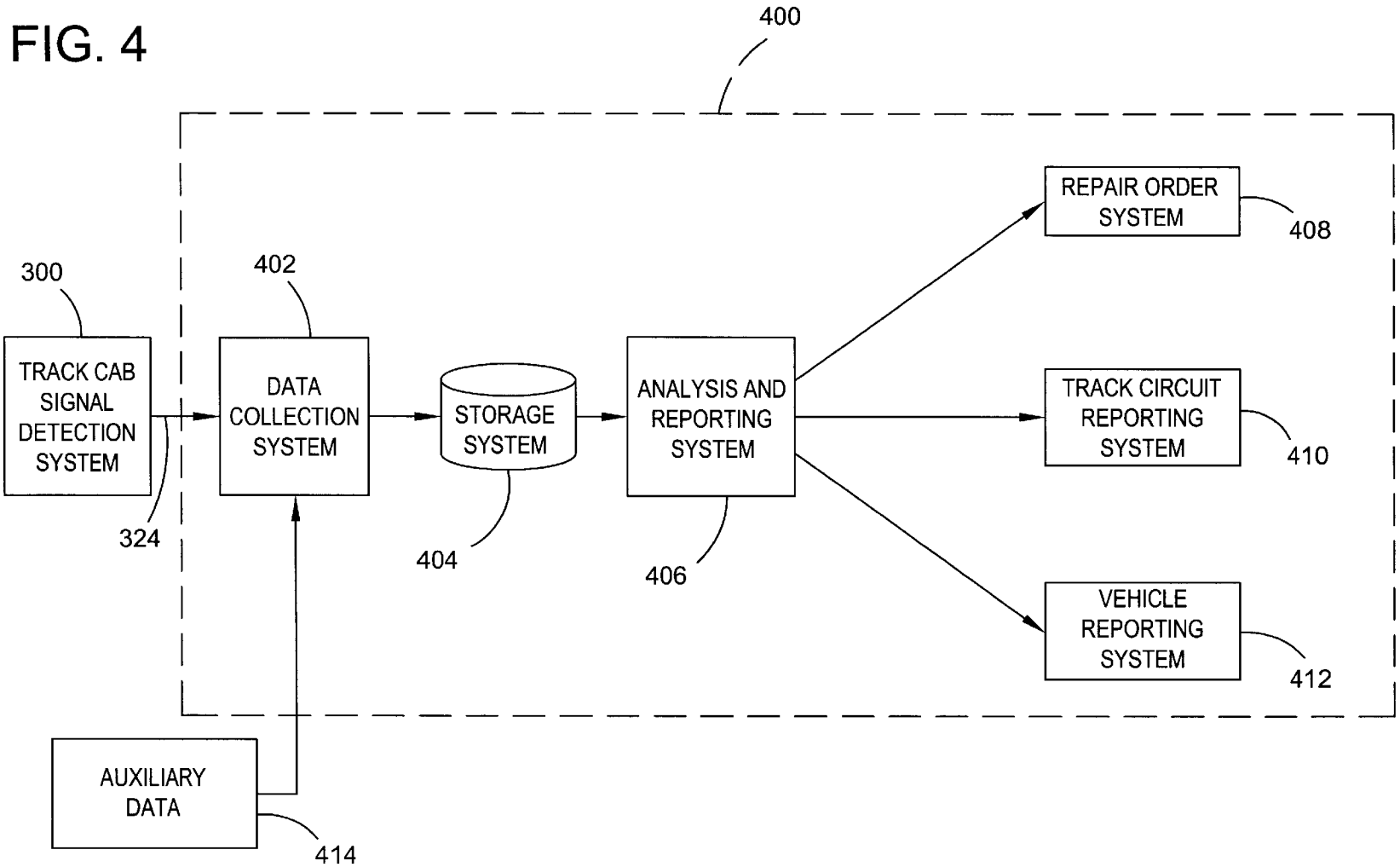
FIG. 4 is a block diagram of a cab signal quality collection and reporting system according to one form of the invention.

FIG. 4 is a block diagram of one embodiment of a cab signal cab signal quality collection and reporting system 400 suitable for use in connection with aspects of the invention. Although aspects of the current invention can be implemented using only detection and reporting system 300, it is also possible to implement aspects of the invention with cab signal quality collection and reporting system 400. With cab signal quality collection and reporting system 400, the quality reports from the various sets of detecting and reporting system 300 may be collected together via a data collection system 402 and stored in a storage system 404. The data collection system 402 can vary, depending on the method of data collection chosen by a given railroad. For example, quality reports may be received via communication link 324 from a plurality of railway vehicles 106 using track detecting and reporting system 300 via personal computers, laptop computers, hand-held computing devices, solid state disks and recording devices, or the like. The data collection system 402 collects the data or reports from the plurality of railway vehicles 106. Additionally, the data collection system 402 receives or obtains auxiliary information or data 414 from other sources that may be used in analysis or in creating reports. For example, in one embodiment, a rail vehicle position identification and tracking system 326 may be used in connection with aspects of the present invention. One such system is available from General Electric Company, which is referred to by the trademark PinPoint™. The PinPoint™ system is a GPS-based tracking system that can monitor the location of a locomotive to within about 100 meters. Such a system 326 may be used to relay the quality reports to a central repository, as well as other useful information (e.g., present vehicle location and status). It should be appreciated that the information made available would allow for improved rail operations efficiency. This collected information may be transferred to the storage system 404.

When cab signal quality collection and reporting system 400 is employed, the analysis and reporting subsystem 406 uses the collected quality reports to provide effective measures of quality and repair notifications that might not otherwise be available using only the track cab signal detection and reporting system 300. For example, auxiliary data 414, which may or may not be the same as the auxiliary data 314 that is available to the detection and reporting system 300, such as reports of completion of repair orders or reports from other reporting systems 300 located on other trains, may be used to further improve the usefulness of the cab signal quality collection and reporting system 400. The analysis and reporting subsystem 406 processes the collected quality reports and auxiliary data to generate repair orders 408, reports on tracks or individual track circuits 410, reports on vehicles 412, or other information as desired. Therefore, it should be understood that the exact set of rules and reports to be used in the analysis and reporting subsystem 406 can vary.

Using an appropriate set of rules and reports, a variety of reports and reporting functions may be generated by the cab signal quality collection and reporting system 400 which may aid in the administration, maintenance and management of a railway system. For example, the cab signal quality collection and reporting system 400 may accurately distinguish between track circuit 128 faults and railway vehicle 106 faults by checking if multiple vehicles 106 report similar quality problems in a particular track circuit 128. Such a system may accurately diagnose certain forms of vehicle faults, such as cab detector 112 or 114 or pickup coil damage, diagnosed when a particular vehicle 106 consistently reports too high or too low cab signal amplitude. A cab signal quality collection and reporting system 400 having access to data and information from a plurality of railway vehicles 106 or time may develop and analyze statistical data on each track circuit 128 and vehicle 106 to report trends that could indicate impending failure, such as carrier frequency drift in a track circuit 128, or coil sensitivity drift in a vehicle 106. Other statistical reports may include the average time to repair in a given track division or locomotive shop, or cost of train delays caused by track circuit problems. In a similar manner, historical records of repairs to a given track circuit 128 or locomotive 106 may be generated in reports to aid in the analysis and identification of maintenance requirements or locations or equipments which may need to be repaired or replaced.

A cab signal quality collection and reporting system 400 may convert location information in vehicle-based format, such as GPS latitude and longitude, or distance traveled since departure test, to operational or system format, such as track number and milepost. The system may directly dispatch repair crews from the nearest repair facility, based on required track circuit corrective action. In another embodiment, the cab signal quality collection and reporting system 400 may send repair orders to the appropriate locomotive maintenance shop such as the next maintenance shop on the route of a failing vehicle 106. Repair orders may indicate the most likely failure mode and the equipment needed for repair, based on the collected quality report data or provide additional useful information, such as driving directions from the maintenance facility to the failing track circuit 128, or the expected arrival time of a failing locomotive 106 at the shop. Repair orders may be sent by various methods as desired by the railroad, such as e-mail, printed repair orders, alphanumeric paging or text messaging.

Of course, in order to effectively manage the reporting process, the cab signal quality collection and reporting system 400 may suppress duplicate repair orders for a given track circuit 128 or vehicle 106 until previously issued repair orders have been completed or suppress or ignore quality reports from vehicles 106 that have failures in their on-board cab signal equipment or operations equipment 200.

In yet another embodiment of the invention, information checks may be designed to indicate track circuit conditions or failures. These information checks may be shown on a display system 316 in addition to being logged in an event log. In this embodiment of the invention, the informational check may indicate a cab status signal rail current above and below a preset amount or a change to a restrictive aspect. For example, an informational check may be made where the rail current is below 2 Amps (133 percent of a calibration level) or above 14 Amps (933 percent of the calibration level). As to the change in restrictive aspect, an informational check may be made where the change is due to an invalid code rate or due to an invalid carrier frequency. The data logged in such informational checks may indicate which condition resulted in the informational check being made.

Although certain embodiments of the present invention have been set forth herein with particularity, these embodiments are meant as examples only and do not limit the present invention. Those of ordinary skill will realize many adaptations, modifications, and useful variants of the apparatus disclosed that are in keeping with the spirit of the present invention.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

What is claimed is:

1. A railroad cab signal quality detection system for use in connection with a railroad cab signaling system in which a status signal is carried on a railroad rail, the status signal having a cab signal parameter that is indicative of a status of a zone of track, the system comprising:

a signal detector for detecting the status signal transmitted via the railroad rail;

a signal measurement subsystem associated with the signal detector for measuring the cab signal parameter; and a quality analysis subsystem for analyzing the measured cab signal parameter and determining a measure of quality of the cab signal parameter.

2. A railroad cab signal quality detection system as set forth in claim 1 wherein the quality analysis subsystem distinguishes between a valid cab signal parameter and an invalid cab signal parameter.

3. A railroad cab signal quality detection system as set forth in claim 1 wherein the quality analysis subsystem detects the marginal operation of a cab signal parameter and reports the quality of the marginal cab signal parameter wherein trends in the marginal cab signal parameter over time indicates the degrading performance of the cab signal parameter.

4. A railroad cab signal quality detection system as set forth in claim 1 wherein the status signal is an analog signal and the system further comprises:

a signal conditioner for conditioning the status signal detected by the signal detector and for providing a conditioned cab signal; and a signal converter associated with the signal conditioner for receiving the conditioned cab signal and converting the conditioned cab signal to a digital cab signal.

5. A railroad cab signal quality detection system as set forth in claim 4 wherein the signal conditioner comprises a filter circuit for filtering one or more ranges of frequencies.

6. A railroad cab signal quality detection system as set forth in claim 4 wherein the signal measurement subsystem digitally processes the digital cab signal for measuring the cab signal parameter and for providing a digital representation of the cab signal parameter to the quality analysis subsystem.

7. A railroad cab signal quality detection system as set forth in claim 6 wherein the quality analysis subsystem compares the digital representation of the cab signal parameter to a predefined rule for determining whether the cab signal parameter is valid or invalid.

8. A railroad cab signal quality detection system as set forth in claim 1 further comprising a database of auxiliary information and wherein the quality analysis subsystem accesses the database of auxiliary information for reporting on the quality of the cab signal parameter.

9. A railroad cab signal quality detection system as set forth in claim 1 further comprising a notification subsystem that provides notifications to the on-board operating crew or remotely to train maintenance personnel.

10. A railroad cab signal quality detection system as set forth in claim 9 wherein the notification subsystem is a display for displaying the measure of quality of the cab signal parameter reported by the quality analysis subsystem.

11. A railroad cab signal quality detection system as set forth in claim 1 wherein the signal detector, the signal measurement subsystem and the quality analysis subsystem are configured for being carried on a railway vehicle.

12. A railroad cab signal quality detection system as set forth in claim 1 wherein the signal detector, the signal measurement subsystem and the quality analysis subsystem are configured as a portable system.

13. A railroad cab signal quality detection system as set forth in claim 1 further comprising a reporting subsystem for receiving information from the quality analysis subsystem regarding the measure of quality of the cab signal parameter and for generating a report containing the received information.

14. A railroad cab signal quality detection system as set forth in claim 13 wherein the reporting subsystem automatically generates a report upon occurrence of a predefined event or condition as detected by or indicated by quality analysis subsystem.

15. A railroad cab signal quality detection system as set forth in claim 1 further comprising a storage subsystem for receiving and storing information or a report from the quality analysis subsystem regarding the measure of quality of the cab signal parameter.

16. A railroad cab signal quality detection system as set forth in claim 1 wherein the quality analysis subsystem analyzes information in the cab signal parameter to determine a source of the potentially invalid cab signal.

17. A railroad cab signal quality detection system as set forth in claim 1 wherein the quality analysis subsystem analyzes information in the cab signal parameter to determine whether the source is one of a failed track circuit, a failing track circuit, an onboard cab signal detector, or an onboard cab signal system.

18. A railroad cab signal quality detection system as set forth in claim 1, further comprising a communication link connected to a remote cab signal quality collection and reporting system to report the measure of quality of the cab signal parameter by communicating the quality of the cab signal parameter as determined by the quality analysis subsystem to a remote location.

19. A railroad cab signal quality collection and reporting system for use in connection with a railroad cab signaling system, an on-board cab signal system, and a railroad cab signal quality detection system in which a status signal is carried on a railroad rail, the status signal having a cab signal parameter that is indicative of a status of a zone of track, the system comprising:

a data collection system for collecting data indicative of a measure of a quality of the cab signal parameter of the status signal; and a quality analysis and reporting system for analyzing the collected data and generating reports responsive to the collected data and indicative of the measure of quality of the cab signal parameter.

20. The railroad cab signal quality collection and reporting system as set forth in claim 19, further comprising a storage system for storing the collected data from a plurality of railroad cab signal quality detection systems.

21. The railroad cab signal quality collection and reporting system as set forth in claim 20, wherein the quality analysis and reporting system further analyzes the plurality of stored collected data associated with the measure of quality of the cab signal parameters and determines a measure of functionality of the railroad cab signaling system, onboard cab signal system and components thereof.

22. The railroad cab signal quality collection and reporting system as set forth in claim 21, further comprising a repair order system generating a repair order when the quality analysis and reporting system determines that the measure of functionality of the railroad cab signaling system, the on-board cab signal system, or components indicates that a repair thereof is needed.

23. The railroad cab signal quality collection and reporting system as set forth in claim 21, wherein the quality analysis and reporting system automatically generates a dispatch to a maintenance system, a communications system or the reporting system wherein the quality analysis and reporting system determines that the measure of functionality of the railroad cab signaling system, the on-board cab signal system, or components thereof require repair.

24. The railroad cab signal quality collection and reporting system as set forth in claim 20, further comprising a database of auxiliary information and wherein the data collection system receives auxiliary information from the database for reporting on the measure of quality of the cab signal parameter.

25. The railroad cab signal quality collection and reporting system as set forth in claim 24, wherein the quality analysis and reporting system further analyzes the collected data associated with the measure of quality of the cab signal parameter and auxiliary information and determines a measure of functionality of the railroad cab signaling system, the on-board cab signal system, and equipment thereof.

26. The railroad cab signal quality collection and reporting system as set forth in claim 25, further comprising a repair order system generating a repair order when the quality analysis and reporting system determines that the measure of functionality of the railroad cab signaling system, the on-board cab signal system, or equipment require repair.

27. A system comprising a locomotive equipped with a railroad cab signal quality collection and reporting system which comprises a cab signal detector for detecting a cab status signal, a cab signal conditioner for receiving the detected cab status signal from the signal detector and providing a conditioned signal to a cab signal converter for converting the conditioned signal from analog to digital format which is indicative of the cab status signal, and a cab aspect display system for displaying the cab status to an operator, further comprising:

a signal measurement subsystem associated with the cab signal detector for measuring a cab signal parameter;

a quality analysis subsystem for analyzing the measured cab signal parameter and determining a measure of quality of the cab signal parameter; and a reporting subsystem for receiving the determined measure of quality of the cab signal parameter from the quality analysis subsystem and for generating a report containing the received determined measure of quality.

28. A railroad cab signaling system comprising a cab signal parameter and a cab signal transmitter for transmitting the cab signal parameter onto a railway rail, further comprising:

a signal detector for detecting the status signal transmitted via the railroad rail;

a signal conditioner for conditioning the status signal detected by the signal detector and for providing a conditioned cab signal;

a signal converter associated with the signal conditioner for receiving the conditioned cab signal and converting the conditioned cab signal to a digital cab signal;

a signal measurement subsystem for measuring a cab signal parameter from the digital cab signal;

a quality analysis subsystem for analyzing the measured cab signal parameter and determining a measure of quality of the cab signal parameter; and a reporting subsystem for receiving the determined measure of quality of the cab signal parameter from the quality analysis subsystem and for generating a report containing the received determined measure of quality.

29. A quality monitoring method for use with a railroad cab signaling system in which a status signal is carried on a railroad rail, the status signal having a cab signal parameter that is indicative of a status of a zone of track, the method comprising:

detecting the status signal;

measuring the cab signal parameter from the detected status signal;

determining a measure of quality of the measured cab signal parameter; and reporting the determined measure of quality of the measured cab signal parameter.

30. A quality monitoring method as set forth in claim 29, wherein determining determines whether the measured cab signal parameter is valid or invalid and wherein reporting reports whether the measured cab signal parameter is valid or invalid.

31. A quality monitoring method as set forth in claim 30 wherein determining if the measured cab signal parameter is valid or invalid comprises digitally processing the detected status signal.

32. A quality monitoring method as set forth in claim 30 wherein determining if the measured cab signal parameter is valid or invalid comprises comparing the measured cab signal parameter to a predefined quality rule.

33. A quality monitoring method as set forth in claim 29 further comprising conditioning the detected status signal prior to measuring the cab signal parameter.

34. A quality monitoring method as set forth in claim 33 further comprising converting the conditioned detected status signal to a form suitable for digital processing.

35. A quality monitoring method as set forth in claim 29 further comprising displaying an indication of the cab signal parameter measured and an indication of the measure of quality of the cab signal parameter.

36. A quality monitoring method as set forth in claim 29 further comprising providing a notification of a corrective action if the measure of quality of the cab signal parameter is less than a predetermined value.

37. A quality monitoring method as set forth in claim 36 wherein the notification is a dispatch to initiate a repair or maintenance of the railroad cab signaling system, the on-board cab signal system, or components thereof.

38. A quality monitoring method as set forth in claim 29 wherein reporting the measure of quality of the measured cab signal parameter comprises storing in a storage system an indication of the measured cab signal parameter and an indication of whether the cab signal parameter is valid or invalid.

39. A quality monitoring method as set forth in claim 38 wherein the storage system is a central storage system suitable for storing information from a plurality of sources.

* * * * *